US005915695A

United States Patent [19]

Wisocki et al.

[11] Patent Number: 5,915,695

[45] Date of Patent: Jun. 29, 1999

[54] BIODEGRADABLE TARGET

[75] Inventors: James Wisocki; Brian Keith Brashaw; Robert Joseph Vatalaro, all of Duluth, Minn.; Timothy Scott Hagan, Superior, Wis.; Roy Douglas Adams, State College, Pa.

[73] Assignee: Bio-Target of America, Inc., Duluth, Minn.

[21] Appl. No.: 09/006,782

[22] Filed: Jan. 14, 1998

[51] Int. Cl.[6] ..... F41J 9/16

[52] U.S. Cl. ..... 273/362

[58] Field of Search ..... 273/362, 363, 273/380

[56] References Cited

U.S. PATENT DOCUMENTS

| | | | |
|---|---|---|---|
| 4,623,150 | 11/1986 | Moehlman et al. | 273/362 |
| 5,174,581 | 12/1992 | Goodson | 273/363 |
| 5,316,313 | 5/1994 | Moore | 273/363 |
| 5,389,142 | 2/1995 | Moore | 273/363 X |
| 5,467,998 | 11/1995 | Hellings | 273/363 |
| 5,649,707 | 7/1997 | Brander et al. | 273/362 |

*Primary Examiner*—William H. Grieb
*Attorney, Agent, or Firm*—Kinney & Lange, P.A.

[57] ABSTRACT

A biodegradable target fabricated from a mixture of a clay material and a peat material molded in a shape of a target.

19 Claims, 1 Drawing Sheet

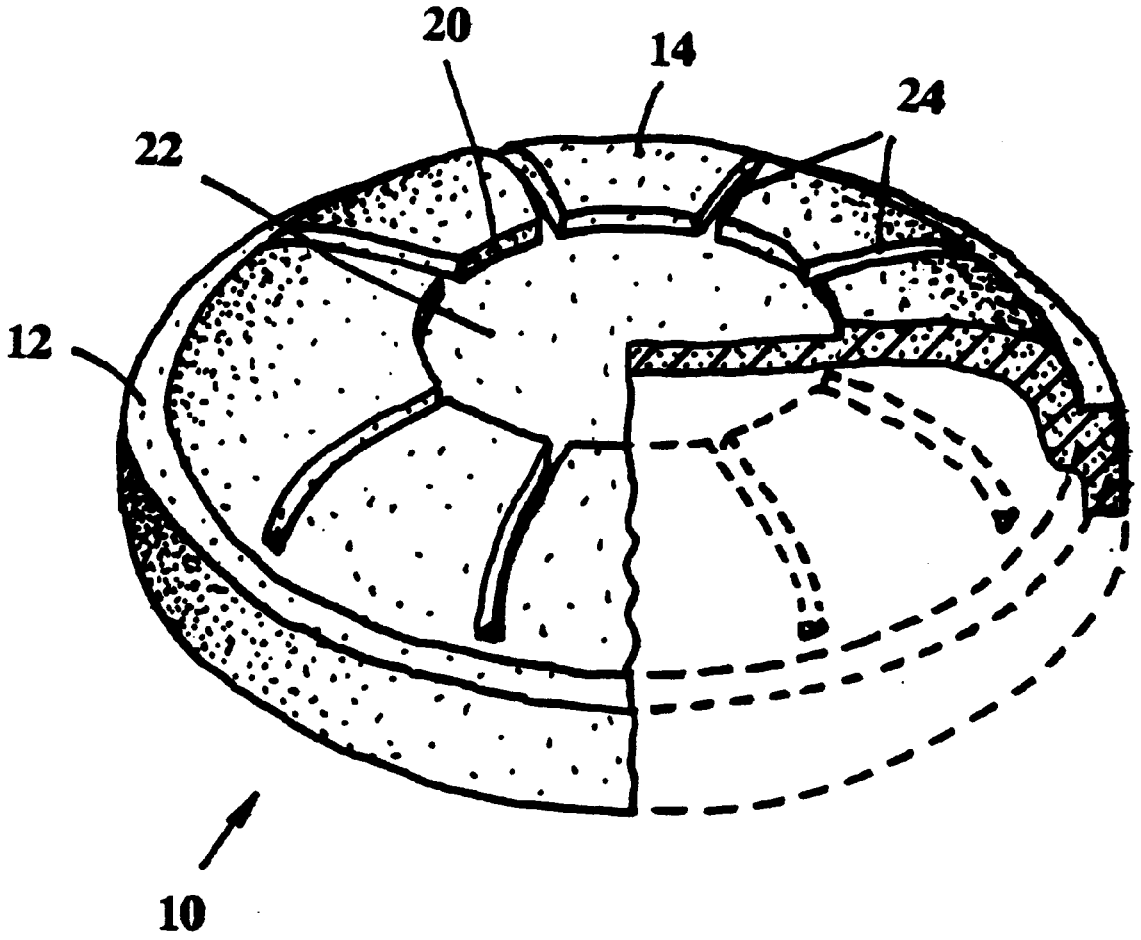
20
14
24
22
12
10

BIODEGRADABLE TARGET

BACKGROUND OF THE INVENTION

The present invention relates generally to a biodegradable target. More particularly, the present invention relates to a biodegradable target formed from a clay material and a peat material.

Recreational shooting is a popular sporting activity. However, the designated seasons within which it is possible for hunters to shoot selected species of animals is typically limited. At times others than these designated seasons, hunters commonly practice shooting at artificial targets. Shooting at large numbers of artificial targets allows hunters to maintain and/or enhance their shooting accuracy.

Artificial targets are typically fabricated from a mixture of clay or limestone and pitch. While these artificial targets exhibit desirable endurance and breakability characteristics, these artificial targets do not readily degrade when exposed to the environment. As such, the areas where artificial targets are used become littered with pieces from the artificial targets.

Attempts have been made to make the artificial targets more biodegradable. For example, Moore, U.S. Pat. Nos. 5,316,313 and 5,389,142, describe unfired dried greenware targets that are fabricated from a mixture of clay, water, and a binder. The binder, which contains sodium silicate and dextrin, is added to the mixture at a concentration of between 1 and 2 percent by weight.

Moehlman et al., U.S. Pat. No. 4,623,150. describes manufacturing the targets from a mixture of inert filler and a non-toxic, water-soluble binder. The inter fillers described in Moehlman et al. are limestone, gypsum, anthracite, and sand. Moehlman et al. indicates that suitable non-toxic, water-soluble binders are starches, dextrins, gums, glues, lignins, waxes, alginates, colloidal silica, silicates, phosphates, aluminates, and clay. Ehlinger, French Patent No. 2,575,818, describes manufacturing artificial targets from clay and quick hardening cement.

In addition to efforts to make artificial targets biodegradable, there have also been efforts to make artificial targets from materials that serve as animal feed. For example, Hellings, U.S. Pat. No. 5,467,998, describes making artificial targets from flour, water, and an edible granular element, such as birdseed. Additionally, Goodson, U.S. Pat. No. 5,174,581, discloses forming artificial targets from a mixture of birdseed, sugar, and water. Goodson indicates that the mixture may also be prepared by mixing legumes or oatmeal with sugar and water.

SUMMARY OF THE INVENTION

The present invention includes a biodegradable target formed from a mixture of a clay material and a peat material. The clay material used with the present invention is preferably ball clay or glacial lake clay. The peat material is preferably reed-sedge peat, rewetted reed-sedge peat, humus peat, or sphagnum peat.

BRIEF DESCRIPTION OF THE DRAWINGS

The sole FIGURE is a partially cut-away, perspective view of a biodegradable target according to the present invention.

DETAILED DESCRIPTION OF THE PREFERRED EMBODIMENTS

The present invention includes a biodegradable target for target shooting. The biodegradable target is fabricated from a mixture of a clay material and a peat material. Fabricating the biodegradable target from the mixture of the clay material and the peat material allows the biodegradable target of the present invention to readily disintegrate when the biodegradable target is exposed to the environment. For example, when the biodegradable target is placed in water, the biodegradable target breaks down into the clay material and the peat material.

The biodegradable target of the present invention also has sufficient strength to be propelled airborne with conventional target throwing equipment. The biodegradable target of the present invention further exhibits desirable characteristics when the target is struck by shotgun pellets. By displaying desirable characteristics, it is meant that the target breaks into at least several pieces when the target is struck by shotgun pellets.

The clay material used in the present invention is preferably ball clay, glacial lake clay, or a combination thereof Ball clay is a highly plastic and sometimes refractory clay that frequently contains organic matter. Ball clay exhibits high wet and dry strength, long vitrification range, and high firing shrinkage. A preferred ball clay is Courtland ball clay, which can be obtained from Minnesota Valley Minerals of New Ulm, Minn. Another type of ball clay that is suitable for use with the present invention is identified as Kentucky ball clay. Preferred glacial clays for use with the present invention are Wrenshall glacial lake clay and Kittson glacial lake clay, which are available from Wrenshall, Minn., and Kittson, Minn., respectively.

Prior to mixing with the peat material, the clay material is preferably dried to a moisture content of less than about 10 percent on a dry weight basis. Even more preferably, the clay material is dried to a moisture content of approximately 3 percent.

The clay material is then ground to a desired particle size in a two-step process. First, the clay material is passed through a roller crusher. Next, the clay material is passed through a pulverizer. The pulverized clay material is then separated into desired particle size classifications by screening. The preferred particle size for the clay material are −20 +50, −50 +100, −100, −100 +200, and −200 mesh. As used herein, the term "mesh" means the number of holes per square inch. The use of the "+" symbol indicates that the clay material was retained on the screen. The use of the "−" symbol indicates that the clay material passed through the screen. The size of the openings for 20, 50, 100 and 200 mesh screens are approximately 0.840, 0.297, 0.149, and 0.074 millimeters, respectively.

The peat material used in the present invention is preferably either reed-sedge peat, humus peat, or sphagnum peat. Prior to use, the peat material is screened to remove rocks, sticks, and other contaminants. A preferred reed-sedge peat for use with the present invention is available from Leoni International of Central Lakes, Minn. A preferred humus peat for use with the present invention is available from Nelson Peat/Topsoil of Duluth, Minn.

In certain circumstances, it is also desirable to reduce the particle size of the peat material. To accomplish the particle size reduction, the peat material is preferably dried, ground to a desired granulation, and then rewetted until the peat material has a desired moisture content. When reed-sedge peat has undergone this process, it is referred to as rewetted reed-sedge peat. The preferred granulations for the peat material are −28 and −35 screen size. The size of the openings for 28 and 35 mesh screens are approximately 0.589 and 0.500 millimeters, respectively.

Other additives that may be incorporated into the biodegradable target of the present invention include fly ash, sand, grain elevator residue, sawmill/wood products residues, carbon black, paper mill sludge, and taconite tailing residues. When additives are used in fabricating the biodegradable targets, the additives replace a portion of the clay material and are added in a concentration of less than 10 percent by weight. Using additives allows the cost of formulating the biodegradable targets to be reduced.

A target mixture is prepared by mixing together between about 65 and 95 percent by weight of clay material and between about 5 and 25 percent by weight peat material. The target mixture preferably contains between about 90 and 103 grams of clay material and between about 13 and 46 grams of peat material. The target mixture is mixed until the target mixture exhibits a substantially uniform consistency and is substantially free of clumps. Depending on the moisture content of the clay material and the peat material, it may be desirable to add water to the target mixture to obtain a desired consistency that is suitable for molding.

The target mixture is then placed in a mold having a desired shape for the biodegradable target. A preferred shape for the biodegradable target according to the present invention is illustrated at 10 in FIG. 1. The biodegradable target 10 preferably has a substantially cylindrical outer ring 12 and a semi-circular dome 14 that extends over the cylindrical outer ring 12.

The semi-circular dome 14 may have a design 20 formed therein. The design 20 may be configured to enhance the aerodynamic properties of the biodegradable target 10. Preferably, the design 20 consists of a central recess 22 and a plurality of finger recesses 24 extending therefrom. Alternatively, the design 20 may convey a commercial image, such as the tradename or trademark of the company that manufactures or markets the biodegradable target 10.

To prevent the mixture from sticking to the mold, the mold is preferably coated with a mold release agent. Pressure is applied to the mold until the pressure on the mold is at least 2,500 pounds per square inch. Preferably, the pressure on the mold is approximately 4,200 pounds per square inch. Once the desired pressure level is attained, the pressure is released and the mold is opened to reveal the molded target. A person of ordinary skill in the art will appreciate that it may be possible to mold the target using different pressure and maintaining the mold pressure at a selected value for a longer period of time depending of the mixture of clay material and peat material used in formulating the mixture.

The molded target has a moisture content of approximately 10 percent by weight. To enhance the durability of the molded target, the moisture content of the molded target is preferably reduced by heating the molded target at a temperature of approximately 350° F. for about 30 minutes. While it is possible to reduce the moisture content by heating the molded target at lower temperatures, it has been found that using a temperature of 350° F. or greater improves the durability and enhances the breakability of the dried target.

The dried targets are then painted. Painting is preferably performed in two steps. During the first step, the entire dried target is preferably painted black. The black paint reduces the rate at which the dried target absorbs moisture. In the second step, the dome of the target is preferably painted orange to enhance the visibility of the target. Suitable paints having the preceding characteristics may be obtained from Van Technologies of Duluth, Minn. While it is possible to cool the dried target before applying the paint, the performance of the painted target is improved if the paint is applied when the dried target is still hot.

After the painting steps are complete, the paint is preferably cured by heating the painted target at approximately 350° F. for about 3 minutes. The painted targets are then allowed to cool. Once the painted targets are cooled, the painted targets are preferably packaged in sealed plastic sleeves to prevent moisture uptake.

Another advantage of the biodegradable target of the present invention is that the biodegradable target produces a dusting having a white or light gray color when the biodegradable target is struck by shotgun pellets. Such a dusting is quite distinct from the black dusting produced by conventional targets. The white or light grey dusting produced by the biodegradable target is easier to see in certain environments that the black dusting produced by prior art targets.

EXAMPLES

The performance characteristics of biodegradable targets according to the present invention was evaluated for various combinations of clay material, peat material, and additives. These examples are intended to illustrate the features of the biodegradable targets but are not intended to limit the scope of the present invention.

Example 1

Prior to mixing the clay material with the peat material, the clay material was screened to one of the following particle sizes +100, −100, and −200 mesh. The moisture content of the clay material was between 1.6 and 5.0 percent by weight. The clay material used in this example was Courtland ball clay.

The peat material used in conducting this example was rewetted reed-sedge peat. The rewetted reed-sedge peat has a particle size of −28 or −35 mesh and a moisture content of between about 49 and 200 percent depending on the particular sample.

A target mixture was prepared by mixing a selected amount of clay material with a selected amount of peat material in the concentrations set forth in Table 1. The clay material and the peat material were mixed together for a sufficient time until the target mixture was substantially uniform and most of the clumps were eliminated.

TABLE 1

| Sample | Clay Material | | | Peat Material | | | Performance |
|---|---|---|---|---|---|---|---|
| Number | Size | Moisture Content | Weight | Size | Moisture Content | Weight | |
| 1 | +100 | 1.6 | 94.0 | −35 | 85 | 23.1 | Best |
| 2 | −100 | 2.1 | 97.0 | −35 | 85 | 18.5 | Good |
| 3 | +100 | 5.0 | 97.1 | −35 | 219 | 18.6 | Better |
| 4 | −200 | 2.7 | 95.0 | −28 | 200 | 30.0 | Better |
| 5 | −100 | 3.7 | 103.7 | −28 | 160 | 13.0 | Good |

A mold having the desired shape of the biodegradable target was coated with a mold release agent to prevent the target mixture from sticking thereto. Approximately 120 grams of the target mixture was placed in the target mold. The force on the mold is gradually increased until the force reached approximately 4200 pounds per square inch. At that time, the pressure was released and the mold was opened to reveal the molded target. The moisture content of the molded target was approximately 10 percent on a dry weight basis. The molded target was then heated in an oven at a temperature of approximately 350° F. for about 30 minutes.

Next, the dried targets were painted in a two-step process in which the entire target was painted black and then the top surface of the target was painted orange. After painting, the paint was cured by heating the painted target to a temperature of approximately 350° F. for about 3 minutes. The performance of the painted target was then analyzed by throwing the target with a commercially available target thrower and then shooting at the target with a shot gun.

The performance of the biodegradable targets according to the present invention was evaluated based on the durability of the target, the ability to use the target with conventional target throwing devices, and the breaking characteristics when the target is struck with shot gun pellets. These criteria were collectively evaluated and the targets were classified as either good, better, or best. Targets classified as best exhibited the most desirable performance characteristics.

Targets produced from clay material having a particle size of −100 mesh (Samples 2 and 5) exhibited good performance. Using clay material with a larger particle size (+100 mesh) increased the performance characteristics to the best category (Sample 1) when compared to the good performance exhibited by using −100 mesh in Sample 2. Increasing the moisture content of the peat material to 219 percent (Sample 3), decreased the performance of the target to better when compared with the performance of the target in Sample 1. The better performance level was also exhibited by Sample 4, which was fabricated from smaller particle size clay material (−200 mesh) and peat material having a moisture content of about 200 percent by weight.

Example 2

The process set forth in Example 1 was used in this Example with the following exceptions. The clay material was Courtland ball clay having a particle size of either +100 or −100 mesh and a moisture content of between about 1.6 and 5.0 percent by weight depending on the sample.

The peat material was humus peat, which was not screened for a particular particle size, as indicated by the designation "All" in Table 2. However, the humus peat was screened to remove rocks, sticks, and other contaminants. The moisture content of the peat material was between about 85 and 219 percent depending on the sample.

TABLE 2

| Sample | Clay Material | | | Peat Material | | | Performance |
|---|---|---|---|---|---|---|---|
| Number | Size | Moisture Content | Weight | Size | Moisture Content | Weight | |
| 1 | +100 | 2.7 | 95.0 | All | 219 | 27.0 | Good |
| 2 | +100 | 2.0 | 94.4 | All | 98 | 24.8 | Good |

TABLE 2-continued

| Sample | Clay Material | | | Peat Material | | | Performance |
|---|---|---|---|---|---|---|---|
| Number | Size | Moisture Content | Weight | Size | Moisture Content | Weight | |
| 3 | +100 | 2.6 | 100.0 | All | 158 | 19.4 | Good |
| 4 | +100 | 3.0 | 97.9 | All | 150 | 25.0 | Good |
| 5 | +100 | 3.0 | 97.9 | All | 145 | 25.0 | Good |
| 6 | −100 | 3.0 | 95.3 | All | 123 | 27.9 | Good |
| 7 | −100 | 3.0 | 95.3 | All | 96 | 24.4 | Good |

A mixture was prepared by mixing the clay material and the peat material in the concentrations of the samples set forth in Table 2. The mixture prepared for Sample 5 further included approximately 1.4 grams of carbon black. When the mixtures were substantially homogeneous, the mixtures were molded into targets. The molded targets were then dried and painted and the performance of the painted targets was evaluated. The targets produced with the various combinations of Courtland ball clay and humus peat all exhibited good performance.

Example 3

The process set forth in Example 1 was used in this Example with the following exceptions. The clay material was Courtland ball clay having a particle size of between +35 and −200 mesh and a moisture content of between about 1.5 and 3.0 percent by weight depending on the sample. Several samples included a blend of clay materials having two different particle sizes.

The peat material was reed-sedge peat, which was not screened for a particular particle size, as indicated by the designation "All" in Table 3. However, the reed-sedge peat was screened to remove rocks, sticks, and other contaminants. The moisture content of the peat material was between about 110 and 186 percent by weight depending on the sample.

A mixture was prepared by mixing the clay material and the peat material in the concentrations for the samples set forth in Table 3. In addition to clay material and peat material Sample 2 also contained about 8.4 grams of fire ash.

When the mixtures were substantially homogeneous, the mixtures were molded into targets. The molded targets were then dried and painted and the performance of the painted targets was evaluated.

Sample 1, which contained the +35 mesh Courtland Ball Clay, exhibited good performance. Each of the targets that were formed from a blend of two granulations of Courtland ball clay (Samples 3–5) exhibited best performance characteristics except for Sample 2, which also contained fire ash. Additionally, Samples 6–7 that contained −100 +200 mesh and −200 mesh Courtland ball clay also exhibited best performance characteristics.

TABLE 3

| | Clay Material | | | | Peat Material | | | |
|---|---|---|---|---|---|---|---|---|
| Sample Number | Size | | Moisture Content | Weight | Size | Moisture Content | Weight | Performance |
| 1 | | +35 | 1.5 | 90.0 | All | 169 | 41.3 | Good |
| 2 | −50 | +100 | 3.0 | 75.9 | All | 140 | 30.0 | Better |
| | | −100 | 3.0 | 9.4 | | | | |

TABLE 3-continued

| Sample Number | Clay Material Size | | Clay Material Moisture Content | Clay Material Weight | Peat Material Size | Peat Material Moisture Content | Peat Material Weight | Performance |
|---|---|---|---|---|---|---|---|---|
| 3 | −50 | +100 | 3.0 | 85.7 | All | 181 | 35.1 | Best |
| | | −100 | 2.7 | 9.5 | | | | |
| 4 | −50 | +100 | 3.0 | 88.1 | All | 135 | 23.5 | Best |
| | | −100 | 3.0 | 9.8 | | | | |
| 5 | −50 | +100 | 3.0 | 88.1 | All | 110 | 28.1 | Best |
| | | −100 | 3.0 | 9.8 | | | | |
| 6 | −100 | +200 | 2.2 | 90.0 | All | 186 | 45.6 | Best |
| 7 | | −200 | 2.0 | 92.5 | All | 186 | 38.0 | Best |

Example 4

The process set forth in Example 1 was used in this Example with the following exceptions. The clay material was a blend of glacial lake clay and ball clay. The glacial lake clay was Kittson glacial lake clay having a particle size of about −100 mesh and a moisture content of about 8.4 percent. The ball clay was Courtland ball clay with a particle size of about −100 mesh and a moisture content of about 2.3 percent. The peat material was reed-sedge peat with all particle sizes and a moisture content of about 173 percent.

A mixture was prepared by mixing together about 36.0 grams of glacial lake clay, about 54.0 grams of ball clay, and about 51.0 grams of reed-sedge peat. When the mixture was substantially homogeneous, the mixture was molded into a target. The molded target was then dried and painted. The performance of the painted target was then evaluated and the performance was classified as good.

Example 5

The process set forth in Example 1 was used in this Example with the following exceptions. The clay material was Wrenshall glacial lake clay having all particle sizes and a moisture content of about 2.0 percent. The peat material was reed-sedge peat with all particle sizes and a moisture content of about 10 percent.

A mixture was prepared mixing together about 76.5 grams of glacial lake clay, about 27.5 grams of reed-sedge peat, and about 21 grams of water. When the mixture was substantially homogeneous, the mixture was molded into a target. The molded target was then dried and painted. The performance of the painted target was then evaluated and the performance was classified as good.

Example 6

The process set forth in Example 1 was used in this Example with the following exceptions. The clay material was a blend of glacial lake clay and ball clay. The glacial lake clay was Wrenshall glacial lake clay having a particle size of about −60 mesh and a moisture content of about 3.0 percent. The ball clay was Courtland ball clay with a particle size of about −40 mesh and a moisture content of about 2.0 percent. The peat material was reed-sedge peat with all particle sizes and a moisture content of about 10 percent.

A mixture was prepared mixing together about 50.0 grams of glacial lake clay, about 50.0 grams of ball clay, about 25.0 grams of reed-sedge peat, and about 12 grams of water. When the mixture was substantially homogeneous, the mixture was molded into a target. The molded target was dried and painted. The performance of the painted target was then evaluated and the performance was classified as good.

Example 7

The biodegradability of the target prepared according to Sample 1 in Example 1 was determined by submerging the target in water. The time for the target to break into small pieces that readily crush when handled was measured. After approximately 8 minutes unpainted targets broke down into small pieces that readily crush when handled. Targets painted according to the procedure set forth in Example 1 took more than 80 minutes to break down into small pieces that readily crush when handled.

Although the present invention has been described with reference to preferred embodiments, workers skilled in the art will recognize that changes may be made in form and detail without departing from the spirit and scope of the invention.

What is claimed is:

1. A biodegradable target comprising a mixture of a clay material and a peat material molded in a shape of a target.

2. The biodegradable target of claim 1, wherein the clay material is a major component of the biodegradable target.

3. The biodegradable target of claim 1, wherein a concentration of clay material in the biodegradable is between about 75 and 95 percent by weight on a dry matter basis.

4. The biodegradable target of claim 1, wherein the clay material is ball clay or glacial lake clay.

5. The biodegradable target of claim 1, wherein the clay material has a particle size of +35, +100, −100 or −200 mesh.

6. The biodegradable target of claim 3, wherein the clay material has a moisture content of less than about 10 percent on a dry matter basis.

7. The biodegradable target of claim 1, wherein the peat material is reed-sedge peat, rewetted reed-sedge peat, humus peat, or sphagnum peat.

8. The biodegradable target of claim 1, wherein the biodegradable target further comprises an additive selected from the group consisting essentially of fly ash, sand, grain elevator residue, sawmill/wood products residues, carbon black, paper mill sludge, or taconite tailing residues.

9. The biodegradable target of claim 8, wherein a concentration of the additive in the biodegradable target is less than approximately 10 percent by weight.

10. A method for fabricating a biodegradable target, the method comprising:

preparing a mixture of a clay material and a peat material; and molding the mixture into a target.

11. The method of claim 10, wherein molding comprises applying a pressure of greater than about 2,500 pounds per square inch to the mixture.

12. The method of claim 11, and further comprising the step of heating the target at a temperature of between about 350° F. and 380° F. for approximately 30 minutes.

13. The method of claim 10, wherein the clay material is ball clay or glacial lake clay.

14. The method of claim 10, wherein the clay material has a particle size of +35, +100, −100 or −200 mesh.

15. The method of claim 10, wherein the clay material is dried to a moisture content of less than about 10 percent on a dry matter basis prior to mixing the clay material with the peat material.

16. The method of claim 10, wherein the peat material is reed-sedge peat, rewetted reed-sedge peat, humus peat, or sphagnum peat.

17. The method of claim 10, and further comprising the step of mixing an additive into the mixture.

18. The method of claim 16, wherein the additive is selected from the group consisting essentially of fly ash, sand, grain elevator residue, sawmill/wood products residues, carbon black, paper mill sludge, or taconite tailing residues.

19. The method of claim 16, wherein a concentration of the additive in the biodegradable target is less than approximately 10 percent by weight.

* * * * *